US007750810B2

(12) United States Patent
Ritter et al.

(10) Patent No.: US 7,750,810 B2
(45) Date of Patent: Jul. 6, 2010

(54) IDENTIFICATION METHOD AND SYSTEM AND DEVICE SUITABLE FOR SAID METHOD AND SYSTEM

(75) Inventors: Rudolf Ritter, Zollikofen (CH); Eric Lauper, Bern (CH)

(73) Assignee: Swisscom Mobile AG, Bern (CH)

( * ) Notice: Subject to any disclaimer, the term of this patent is extended or adjusted under 35 U.S.C. 154(b) by 282 days.

(21) Appl. No.: 11/814,424

(22) PCT Filed: Jan. 19, 2006

(86) PCT No.: PCT/EP2006/050310

§ 371 (c)(1),
(2), (4) Date: Jul. 20, 2007

(87) PCT Pub. No.: WO2006/077234

PCT Pub. Date: Jul. 27, 2006

(65) Prior Publication Data

US 2008/0129457 A1 Jun. 5, 2008

(30) Foreign Application Priority Data

Jan. 21, 2005 (EP) ..... 05100391

(51) Int. Cl.
*G08B 13/14* (2006.01)

(52) U.S. Cl. ..... 340/572.1; 340/330; 340/539.1; 340/539.12; 340/539.11; 340/573.1; 340/825.36; 340/825.49

(58) Field of Classification Search ..... 340/330, 340/539.12, 539.1, 539.11, 573.1, 825.36, 340/825.49
See application file for complete search history.

(56) References Cited

U.S. PATENT DOCUMENTS

| | | | | |
|---|---|---|---|---|
| 5,499,626 | A | 3/1996 | Willham et al. | |
| 7,382,247 | B2 * | 6/2008 | Welch et al. | 340/539.12 |
| 2003/0173408 | A1 | 9/2003 | Mosher, Jr. et al. | |

FOREIGN PATENT DOCUMENTS

| | | |
|---|---|---|
| DE | 196 07 222 | 8/1997 |
| EP | 0 990 756 | 4/2000 |
| EP | 1 387 323 | 2/2004 |
| GB | 2 386 885 | 10/2003 |
| WO | 01 54074 | 7/2001 |

* cited by examiner

*Primary Examiner*—Daryl Pope
(74) *Attorney, Agent, or Firm*—Oblon, Spivak, McClelland, Maier & Neustadt, L.L.P.

(57) ABSTRACT

A method system, and device for identification by an identification tag in which a request to a control module of the identification tag is transmitted from an interrogation device via a contactless interface of the identification tag, so that the control module accesses identification data stored in a memory module assigned to the identification tag. The identification data are transmitted via the contactless interface. Body-specific identification data of the wearer are captured and transmitted to a verification module by a measuring device assigned to the identification tag, or a sensor, and/or an analysis device. The transmitted body-specific identification data is compared with the identification data stored in the memory module by the verification module, to confirm the identity of the wearer. The identification tag is injected and/or implanted under the skin of the wearer. The identification tag can be in particular an RFID and/or NFC tag.

24 Claims, 1 Drawing Sheet

IDENTIFICATION METHOD AND SYSTEM AND DEVICE SUITABLE FOR SAID METHOD AND SYSTEM

TECHNICAL FIELD

The present invention relates to an identification method and a system and a device suitable therefor. The present invention relates in particular to a method, a system and a device for user identification by means of an implantable identification tag, the identity of the wearer being checked by means of a verification module.

BACKGROUND ART

Radio Frequency Identification (RFID) is a technology for unambiguous and contactless identification of objects, good, animals or persons. It enables a quick and automatic data capture by means of radio waves, so that the information can be selected and transmitted considerably more quickly and conveniently. An RFID system thereby consists essentially of one or more RFID chips or tags and the suitable RFID reading device. RFID tags are ordinarily flat chips in different sizes, which are able to send data by radio waves to a reading device via an antenna. They have moreover one or more storage devices, which are able to store different quantities of data, depending upon the design. In addition to this, there are basically two types of RFID tags: active and passive. While the active tags are provided with their own power supply, and transmit until they are exhausted, the antenna with many RFID tags not only takes care of the transmission but also of the power supply. With this antenna, the tag, activated through the reading device, can generate the required energy for the data transmission practically by itself. These passive chips have an almost endless service life.

Based in addition on the RFID technology is the Near Field Communication (NFC). This wireless communication technology—known also as Nahfunktechnik—enables the data transmission of small quantities of data over short distances. RFID chips have a range of five to ten meters, while NFC can exchange data only at a maximal distance of ten centimeters, however. A first advantage of the NFC technology is thus that very small, inexpensive radio transmitters can be used, which only use little energy. On the other hand, the eavesdropping on NFC-Chips is almost impossible owing to the weak signal, and thus useful also for security-critical applications. The main difference to RFID is, however, that NFC makes possible the quick establishment of a connection of peer-to-peer networks. As with Bluetooth, the NFC devices find themselves automatically, and establish a connection to one another. In contrast to NFC, Bluetooth requires a short time span to connect itself to other devices, and usually requires the intervention of a user, who has to enter a corresponding PIN code for this purpose. RFID networks are based, for their part on so-called master/slave roles, since the chips are usually queried by the reading devices. Devices with NFC support, on the other hand, are able to work both in the active as well as in the passive mode. In the passive way of working, the NFC chips can even send identification data when the wearer device is switched off or does not have at its disposal an own power supply or this power supply has failed.

The RFID and NFC technology make accessible, in particular in the field of logistics, material administration, industry automats and service, new practical areas of application. Thus it is possible, for example, to store on the chips the price of goods, their shelf life, their place of manufacture, vendors the time of importation and much more, and to read it as required. The RFID or respectively NFC technology provides valuable services, for instance, also with the finding of lost pets in that animals are provided with so-called transponders with an injection under the skin. These microchips store an identification number. When a lost pet appears at a veterinarian or an animal shelter, the identification number can be read using a suitable device, whereby the animal can then be identified via a pet register and can be brought back to its owner.

However, the RFID or respectively NFC technology, in particular since the development of implantable chips, is playing a more and more important role also in the area of identification of persons. There exist today transponders the size of a grain of rice, packed in glass, which using local anesthesia can be injected in a pain-free way under the human skin and which cannot be discerned by eye. These radio-capable transponders contain an individual identity number which only occurs once. An independent tag is thus created. When this identification tag (either an RFID or an NFC tag) is held in the vicinity of a scanner, it emits this personal identity number, thanks to a weak current emanating from the scanner. The wanted signal is modulated via the feed signal whereby bidirectional communication is also made possible.

Especially important areas of application for implantable identification tags are health, finance and security fields, where the air is to ensure, on the one hand, quick and unambiguous identification of persons, and, on the other hand, the exclusion of not authorized persons. In the area of finance, the user of RFID and NFC chips should offer bank customers and users of credit cards the additional security that their accounts become usable for the first time when they seek access personally, and during the transaction are also physically present. These chips are also recommended to better secure access to government buildings, nuclear facilities, research laboratories, important offices, prisons and transport facilities such as airports and airplanes, ships and trans-ports with valuable objects or secret materials. On the other hand, by means of the RFID or respectively NFC tags it can be ensured that no persons leave certain premises or areas. In a prison for example, all inmates can be assigned identification tags, which are read at regular intervals, so that the location and the movements of persons can be followed in real time.

The drawbacks of these systems consist however in that in particular there is no guarantee that such an identification tag (both an RFID as well as also an NFC tag) with personal identification data is actually worn by the person referenced on the identification tag. Both RFID as well as NFC tags can be very simply injected under the skin or otherwise placed, but also correspondingly easily removed again and implanted in another person. Thus unauthorized persons can gain access to high facilities, for example, or use false identities in order to carry out payments with their credit cards.

DISCLOSURE OF INVENTION

It is therefore an object of the present invention to propose a new method, a new system and a new device for user identification which do not have the drawbacks of the state of the art. Understood as users can be in particular users of mobile communication devices, but also other people as well as other living organisms.

These objects are achieved according to the invention in particular through the elements of the independent claims. Further advantageous embodiments follow moreover from the dependent claims and from the specification.

In particular these objects are achieved through the invention in that a request to a control module of the identification tag is transmitted from an interrogation device via a contactless interface of the identification tag, that by means of the control module identification data stored in a memory module assigned to the identification tag is accessed and that the identification data are transmitted via the contactless interface, by means of a measuring device assigned to the identification tag or a sensor and/or by means of an analysis device body-specific identification data of the wearer are captured and transmitted to a verification module, by means of the verification module the transmitted body-specific identification data of the wearer being compared with the identification data stored in the memory module and the identity of the wearer is confirmed by means of the verification module, and identification tag being injected and/or implanted under the skin of the wearer.

The capturing of body-specific identification data of the wearer and the checking of the identity of the wearer in that the transmitted body-specific identification data are compared with the identification data stored in the memory module has the advantage among others, that the user identification can take place in an especially easy and reliable way. In particular it can be ensured that the wearer of the identification tag is actually the person referenced on the identification tag the possibility of identity theft or identity fraud being limited considerably. The injection or respectively placement of the identification tag under the skin of the wearer has the advantage, among others, that the identification tag is always worn, and the user does not have to be concerned about identification means such as identity cards, stamp cards, or chipcards. An identification tag placed under the skin also cannot be lost or stolen, while even abuse through violent theft becomes considerably more difficult. As a rule, the insertion of the identification tags leaves no marks on the skin, so that the position of the identification tag on the body cannot be simply determined.

In an embodiment variant, the identification tag is an RFID tag. This embodiment variant has the advantage, among others, that the amenities of the RFID technology can be optimally exploited. Also in a further embodiment variant the identification tag is an NFC tag. This embodiment variant has the advantage, among others, that the conveniences of the NFC technology are especially able to be demonstrated.

In an embodiment variant, the verification module is assigned to the identification tag. This embodiment variant has the advantage, among others, that the captured body-specific identification data after capture can be processed within the identification tag, where the stored reference identification data are located. The comparison of the captured and stored identification data and the thus connected identification check is thereby carried out in an especially efficient way.

Preferably, according to the principle of the single-serving mechanism, the reference identification data stored inside the identification tag are captured and stored immediately after insertion of the identification tag. This way of proceeding prevents the identification tag from being able to be transplanted from one creature into the next.

In another embodiment variant, the measuring device or sensor and/or the analysis device is integrated into the identification tag. This embodiment variant has the advantage, among others, the capturing of the body-specific data which are needed for the identification check takes place within the identification tag, whereby a quicker identification is made possible. Moreover, in this embodiment variant, the captured body-specific identification data never leave the identification tag, which leads to a heightened security level since it is much more difficult to get to these identification data for purposes of fraud.

In another embodiment variant, the identity of the wearer is confirmed by means of the verification module, if the probability of a match of the transmitted body-specific identification data to particular stored identification data lies above a predefinable threshold. This embodiment variant has the advantage, among others, that the degree of matching of the captured and stored body-specific identification data is adjustable according to application and need.

In still another embodiment variant the identity of the wearer is confirmed by means of the verification module if the transmitted body-specific identification data match the particular stored identification data in a one-to-one way. This embodiment variant has the advantages among others, that especially precise identification mechanisms and especially unambiguous body-specific identification data may be used, which can play a very important role, for instance, with identification for access to very security-sensitive rooms and/or facilities.

In another embodiment variant the body-specific identification data comprise DNA-specific and/or blood value-specific data. This embodiment variant has the advantage, among others that based on these body-specific features people can be identified with a very good level of security, or respectively—in the case of DNA—almost complete certainty. The risks of an identity theft and incorrect identification of users are thereby reduced further or even eliminated.

In another embodiment variant, the body-specific identification data comprise a DNA signature and/or a hash of the DNA structure. This embodiment variant has the advantage among others, that the DNA signature or respectively hash of the DNA structure makes possible an extremely secure and unambiguous identification, forgery or identity theft being eliminated.

In a further embodiment variant the identification data transmitted via the contactless interface are encrypted by means of an encryption module. This embodiment variant has the advantage, among others, that the security of the user identification is considerably increased through the encryption of the transmitted data, whereby the potentially very susceptible and eavesdropping-endangered transmission of data is secured against possible attacks. The data encryption can thereby be based on symmetrical or asymmetrical encryption methods.

In still another embodiment variant, the identification data transmitted via the contactless interface comprise authentication data for authentication in a mobile radio network, in particular IMSI and/or MSISDN and/or another access key. This embodiment variant has the advantage, among others that the users of mobile radio services are authenticated and authorized in a convenient and secure way. In addition, the users are not bound to a particular mobile radio device, but may use any device with the corresponding interfaces for its specific security functions.

In another embodiment variant, the memory module assigned to the identification tag comprises multiple identities. This embodiment variant has the advantage, among others, that different identities can be used for different security applications and security functions. In particular, the anonymity of the user can thereby be safeguarded since with each identification request in principle another identity can be used, for example according to a pseudo-random generator, whereby it is considerably more difficult to use the identity of the user in a fraudulent way. In principle, both the identity of a user can be queried, but also his identification checked and confirmed. Multiple identities are possible; typically one identity per system or respectively per service provider is used.

It should be stated here that, in addition to the method according to the invention, the present invention also relates to a system for carrying out this method as well as a device suitable therefor.

BRIEF DESCRIPTION OF DRAWING

An embodiment variant of the present invention will be described in the following based on examples of the embodiments are illustrated by the following attached FIGURE.

MODES FOR CARRYING OUT THE INVENTION

Figure 1:
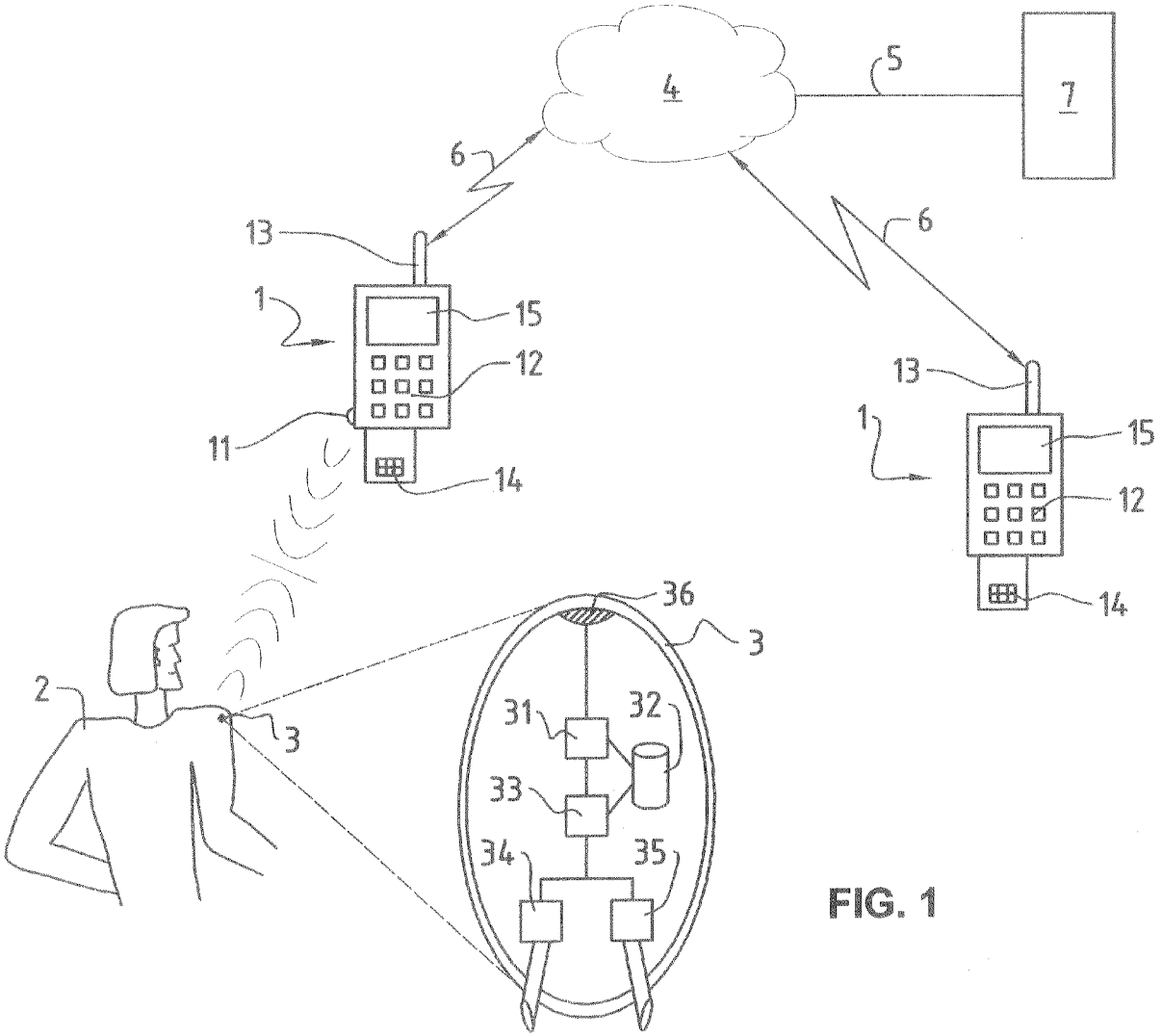
FIG. 1 shows a block diagram illustrating schematically a method and a system for user identification in a mobile radio network, as well as an identification device suitable therefor.

FIG. 1 illustrates an architecture which can be used to achieve the user identification according to the invention. FIG. 1 shows a block diagram illustrating schematically an identification method according to the invention and a system for user identification, as well as a device suitable therefor. In FIG. 1, the reference numeral 1 refers to a mobile communication terminal. To be understood by mobile communication terminal 1 are, among others, all possible so-called Customer Premise Equipment (CPE), which comprise, on the one hand, mobile radio telephones, for example GSM, UMTS or satellite mobile radio telephones, but also, on the other hand, all IP-capable devices, such as e.g. Personal Computers (PC), Personal Digital Assistants (PDA), portable computers (Laptops) or play consoles such as Playstation®, Xbox®, Gameboy® or Gamecube®.

In particular, the mobile communication terminal 1 is provided with a physical network interface 13, by means of which voice and/or data information can be exchanged between the mobile communication terminal 1 and a communication network 4 via the communication channel 6. The network interface 13 can support a multiplicity of different network standards, for example GSM (Global System for Mobile Communication), GPRS (Generalized Packet Radio Service), UMTS (Universal Mobile Telecommunications System) or satellite radio systems. The interface 13 can likewise be an interface to local wireless networks, for instance WLAN (Wireless Local Area Network) 802.11, Bluetooth infrared-network or any other contactless interface. The interface 13 can also be any contacted interface, for example a USB or a FireWire interface or an interface to Ethernet, Token Ring or any other wired LAN (Local Area Network) or to Internet based on an analog, digital or xDLS modem connection. The reference numeral 4 in FIG. 1 in this sense represents the different communication networks, for example land- or satellite-based mobile radio network, PSTN (Public Switched Telephone Network), WLAN 802.11 or Bluetooth network, Ethernet or Token Ring, etc.). In principle, it must be stressed that the identification method and/or system according to the invention as well as the identification device according to the invention is not bound to a specific network standard, as long as the features according to the invention are present, but can be achieved with any one or more networks, in particular also in that the mobile communication device 1 switches or routes transparently between the different networks 4. In this respect, the mobile communication device 1 can in particular support the specifications of the standards for seamless change of voice and data carrier services such as e.g. UMA (Unlicensed Mobile Access) for seamless transfer between WLAN, GSM/GPRS and Bluetooth, SCCAN (Seamless Converged Communication Across Networks or Bluephone.

Above and beyond this, the mobile communication device 1 can be connected via a contacted interface to an identification module 14, which is used, for instance, for identification of the mobile communication devices 1 in the mobile radio network 4. In particular this identification module 14 can be a SIM card (Subscriber identity Module), which can contain carrier-relevant data. However, the communication device 1 can also get by without any additional identification module 14, which has no influence on the fundamentals of the invention. The mobile communication device 1 can moreover have at its disposal input elements 12, by means of which data and/or commands to use and/or to execute on the mobile communication device 1 or to transmit over the communication interface 13 can be entered. Furthermore mobile communication device 1 can comprise output elements 15 which are used to output and/or reproduce acoustical and/or optical signals as well as picture and/or sound data to the wearer 2. Also the input and output elements 14/15 in the conventional sense are no compulsory elements of the invention. In addition, the mobile communication device 1 comprises a further physical interface 11 by means of which data information can be ex changed between the mobile communication terminal 1 and an identification device 3 via a wireless communication channel in near range (NFC). In this sense the communication terminal 1 can be assigned personally, i.e. unambiguously to a wearer 2. Conceivable, however, are also completely impersonal communication terminal 1, which can be used by any user and/or a group of any users.

The reference numeral 7 in FIG. 1 refers to a further communication terminal. This communication terminal 7 can be, for example, a fixed net telephone, a wired or wireless house telephone, an IP-capable telephone (for VoIP communication) or any other network device for transmission of voice and/or data information. In particular, this further communication terminal 7 can also be a mobile radio telephone, or can also be integrated into another Customer Premise Equipment (CPE), for example as a so-called soft phone or a telephone application of a personal computer. The communication terminal 7 has at its disposal one or more suitable interfaces to be able to establish a voice- and/or data exchange over a communication channel 5. Via the communication network 4, finally, communication between the mobile communication terminal 1 and the communication terminal 7 can be established, for which possibly further devices, not shown in FIG. 1, may be needed, for example gateways and/or proxies.

The reference numeral 3 in FIG. 1 refers to an identification device, by means of which the identity of a wearer 2 can be determined. This identification device 3 can be achieved in particular as an RFID tag, but also as any other device which could release the identification data stored thereon for a wearer 2 upon request. In particular this identification device 3 can also be an NFC tag. The identification tag 3 typically comprises a memory module 32 for storing identification data, an integrated contactless interface 36, as well as a control module 31, by means of which the exchange of data between the identification tag 3 and an external interrogation device via the interface 36 can be controlled. In particular it is possible for communication and/or data exchange between the identification tag 3 and the mobile communication terminal 1 to be established via the interface 36. The physical interface 36 of the identification tag 3 and the corresponding physical interface 11 of the mobile communication terminal 1 thus support the common data transmission protocols for data transmission. It is to be mentioned here that the data exchange of the identification tag 3 is achievable by means of a single interface 36 or also by means of more than one physical communication interface, for example in that a communication interface is optimized only for reception and a further communication interface only for the emission of the signals.

The identification tag 3 further comprises a measuring device or sensor 34 and/or analysis device 35. The measuring device or respectively sensor 34 can capture body-specific data of the wearer 2 through a direct measurement. In particular, these measuring devices or sensors can be nanosensors. The body-specific data captured by the measuring device or respectively sensor 34 comprise, for example, the body temperature, the pH value of the skin on a particular body part of the wearer 2, as well as blood pressure or pulse values in certain situations. The analysis device 35 ascertains the body-specific data of the wearer 2 after processing and analysis of the captured samples. The examples of data which can be determined by this analysis device 35 are DNA-, blood-value-, perspiration- and/or urine-specific data. The measuring device or respectively sensor 34 and/or the analysis device 35 can capture in principle, however any body-specific identification data, or combinations thereof, that make possible an unambiguous or partial identification of the wearer 2.

The RFID or respectively NFC tag 3 can be worn either under or on the skin of the wearer 2. If the identification tag 3 is worn under the skin of the wearer 2, then it is placed under the skin by means of a suitable method, for example injected or otherwise implanted. This embodiment variant is especially advantageous in view of the increased identification security and of the greater convenience for the wearer 2. In particular, an identification tag 3 placed under the skin cannot be lost or forgotten, and also it is much more difficult for potential identity thieves to get to the valuable identification data of the wearer 2. In any case, the RFID or respectively the NFC tag 3 should be in connection with the body of the wearer 2 by means of a body-contacted interface or directly, so that the measuring device or sensor 34 or respectively the analysis device 35 can capture corresponding body-specific identification data of the wearer 2. The body can thereby be used as a data bus. Moreover the measuring device or respectively sensor 34 can also be implemented as a membrane or nanosensor. Even an implanted identification tag 3 does not necessarily have to be fixed to a fixed position under the skin of the wearer 2. Also conceivable are identification tags 3 which are movable in the body of the wearer 2, for instance in the blood vessels or in the stomach-intestinal tract of the wearer 2.

The identification tag 3 can moreover also be configured as a logical unit, which is distributed, however, among different physical units. In this connection, the distributed identification tags 3 have especially suitable communication interfaces which enable them to communicate among themselves wirelessly and exchange data, also without the intervention of the user 2. This distributed configuration of the identification tag 3 has the advantage, among others, that the actual sensor or respectively reference key is not detectable or only detectable with great difficulty.

The identity of the wearer 2 is confirmed by a verification module 33, based on the stored identification data, as well as wearer identification data which are captured by means of the measuring device or respectively sensor 34 and/or by means of the analysis device 35. The verification module 33 thereby compares the transmitted captured body-specific identification data with the corresponding data for the wearer 2 stored in the memory module 32 of the identification tag 3. The wearer 2 is identified, for example, by means of the verification module 33 if the probability of a match of the transmitted body-specific data to particular stored body-specific data lies above a predefinable threshold. In this way allowances can be made for different application situation for the identification system, depending upon required security level, data capturing precision, and identification precision of the respective body-specific data. In particular the predefinable threshold can also be selected to be equal to zero, which requires a one-to-one match of the captured and the stored identification data. The memory module 32 can be connected directly to the verification module 33, or exist as separate module inside the identification tag 3. The verification module 33, for its part, can be assigned to the RFID or respectively the NFC tag 3, but also be separate therefrom and be connected via a corresponding preferably contactless communication interface.

With an identification request on the part of the mobile communication device 1, a corresponding request is transmitted to the control module 31 of the identification tag 3 via the communication interfaces 13 and 36. The control module transmits this request to the measuring device or sensor 34 and/or analysis device 35, which capture the required body-specific identification data of the wearer 2. The captured body-specific identification data of the wearer 2 are transmitted to the verification module 33, and evaluated and/or checked by means of the verification module 33. For this purpose, the verification module 33 compares the captured body-specific identification data of the wearer 2 with identification data stored in the memory module 32 of the identification tag 3. Depending up the predefined threshold, i.e. depending upon the security policy and/or use of the system the identity of the wearer 2 is confirmed or denied. After confirmation of the wearer identity, the necessary identification data are transmitted via the communication interfaces 36 and 13 to the mobile communication device 1 by means of the control module 31. Thus the identification can be compared with the identification by means of MAC address (Media Access Control). Involved in the case of the MAC address is the hardware address of all network devices which serve the unambiguous identification of the device in the network. Each identification tag 3 contains an unambiguous and unique number, whereby the wearer 2 of the identification tag 3 is also unambiguously identifiable. This type of identification is especially suitable for human-to-human IP communication.

For the authentication of the identification tag 3 a challenge-response method can be used, for instance. In particular special encryption, algorithms and hash values can thereby be used, for example. With this authentication method, requests from clients are answered by the server with a random byte sequence, the so-called challenge, and a random number (called identifier). The client must respond to the challenge correctly in that he links it to a password, which is known to the server and the client, and calculates therefrom, by means of a hash function, a hash value which he sends back to the server. This server likewise calculates a hash value from the data, and compares it with that which was sent to it by the client. In the case of a match, the request is carried out.

Through the capturing and the checking of the body-specific identification data of the wearers 2, the method according to the invention can also be used to monitor the vital values of the wearer 2 and to trigger corresponding messages if the vital values indicate death of the wearer 2. For example, by means of the communication device 1, the ambulance and/or the police can be notified automatically; a local optical and/or acoustical alarm can also be triggered however. Moreover, by means of the method according to the invention it can be ensured that the identification of deceased persons is automatically switched off, whereby a further reduction in identity theft can be achieved.

In principle, data corresponding to multiple identities can be stored on the identification tag 3. The use of different identities makes possible a finer and more precise identification for various security applications and functions. Through the use of different identities, the anonymity of the user can also be ensured, since with each identification procedure a new stored identity can be used, for example according to a pseudo-random generator, whereby abuses are able to be limited further, and the identification of the wearer 2 can be secured with a still higher degree of reliability.

In another embodiment variant, the identification method according to the invention can be used in particular for the purpose of access to definable premises and/or use of definable devices, based on the identification and authorization of the wearer 2. Thus, also in other respects, very security-critical systems can be managed and monitored simply and efficiently, and the identity of the access-authorized persons guaranteed. On the other hand, It can also be ensured through the identification method according to the invention that certain persons do not leave the premises and/or areas assigned to them.

The invention claimed is:

1. An identification method by an identification tag, comprising:

transmitting a request to a control module of the identification tag from an interrogation device via a contactless interface of the identification tag;

accessing identification data stored in a memory module assigned to the identification tag by the control module;

transmitting the identification data via the contactless interface;

capturing and transmitting body-specific identification data of a wearer to a verification module by a measuring device assigned to the identification tag or by at least one of a sensor or by an analysis device;

comparing the transmitted body-specific identification data of the wearer with the identification data stored in the memory module by the verification module; and confirming the identity of the wearer by the verification module, wherein the identification tag is at least one of injected or implanted under the skin of the wearer.

2. The method according to claim 1, wherein the identification tag is an RFID tag.

3. The method according to claim 1, wherein the identification tag is an NFC tag.

4. The method according to claim 1, wherein the verification module is assigned to the identification tag.

5. The method according to claim 1, wherein the measuring device or at least one of the sensor or the analysis device are integrated in the identification tag.

6. The method according to claim 1, wherein the identity of the wearer is confirmed by the verification module, if a probability of a matching of the transmitted body-specific identification data with particular stored identification data is above a predefinable threshold.

7. The method according to claim 1, wherein the identity of the wearer is confirmed by the verification module if the transmitted body-specific identification data match one-to-one with particular stored identification data.

8. The method according to claim 1, wherein the body-specific identification data comprise at least one of DNA or blood value-specific data.

9. The method according to claim 8, wherein the body-specific identification data comprise at least one of a DNA signature or a hash of the DNA structure.

10. The method according to claim 1, wherein the identification data transmitted via the contactless interface are encrypted by an encryption module.

11. The method according to claim 1, wherein the identification data transmitted via the contactless interface comprise at least one of authentication data for authentication in a mobile radio network, IMSI, or MSISDN.

12. The method according to claim 1, wherein the memory module assigned to the identification tag comprises multiple identities.

13. A system for user identification by an identification tag, which identification tag including a contactless interface for transmission of requests from an interrogation device to a control module of the identification tag, by which control module the identification data stored in a memory module assigned to the identification tag are accessible, and the identification data being transmittable via the contactless interface, the system comprising:

at least one measuring device assigned to the identification tag or at least one of a sensor or an analysis device, by which body-specific identification data of a wearer are captured and are transmittable to at least one verification module; and the at least one verification module for comparing the transmitted body-specific identification data of the wearer with identification data stored in the memory module, by which the identity of the wearer is able to be confirmed, wherein the identification tag is at least one of injected or implanted under the skin of the wearer.

14. The system according to claim 13, wherein the identification tag is an RFID tag.

15. The system according to claim 13, wherein the identification tag is a NFC tag.

16. The system according to claim 13, wherein the verification module is assigned to the identification tag.

17. The system according to claim 13, wherein the measuring device or at least one of the sensor or the analysis device are integrated in the identification tag.

18. The system according to claim 13, wherein the identity of the wearer is confirmed by the verification module, if a probability of a matching of the transmitted body-specific identification data with particular stored identification data is above a predefinable threshold.

19. The system according to claim 13, wherein the identity of the wearer is confirmed by the verification module if the transmitted body-specific identification data match one-to-one with particular stored identification data.

20. The system according to claim 13, wherein the body-specific identification data comprise at least one of DNA-specific data or blood value-specific data.

21. The system according to claim 20, wherein the body-specific identification data comprise at least one of a DNA signature or a hash of the DNA structure.

22. The system according to claim 13, wherein the identification data transmitted via the contactless interface are configured to be encrypted by an encryption module.

23. The system according to claim 13, wherein the identification data transmitted via contactless interface comprise at least one of authentication data for authentication in a mobile radio network, IMSI, or MSISDN.

24. The system according to claim 13, wherein the memory module assigned to the identification tag comprises multiple identities.

* * * * *

UNITED STATES PATENT AND TRADEMARK OFFICE

CERTIFICATE OF CORRECTION

PATENT NO. : 7,750,810 B2
APPLICATION NO. : 11/814424
DATED : July 6, 2010
INVENTOR(S) : Rudolf Ritter et al.

It is certified that error appears in the above-identified patent and that said Letters Patent is hereby corrected as shown below:

On the title page, Item (73), the Assignee should read:

-- (73) Assignee: Swisscom AG, Bern, (CH) --

Signed and Sealed this

Twelfth Day of October, 2010

David J. Kappos

David J. Kappos
*Director of the United States Patent and Trademark Office*